United States Patent [19]

Mollet et al.

[11] 4,374,914

[45] Feb. 22, 1983

[54] PROCESS FOR THE PRODUCTION OF NEGATIVE COLOR IMAGES BY THE SILVER DYE BLEACH PROCESS, AND THE SILVER DYE BLEACH MATERIAL USED IN THIS PROCESS

[75] Inventors: Herbert Mollet, Tentlingen; Dieter Wyrsch, Marly, both of Switzerland

[73] Assignee: Ciba-Geigy Ltd., Basel, Switzerland

[21] Appl. No.: 282,777

[22] Filed: Jul. 13, 1981

[30] Foreign Application Priority Data

Jul. 22, 1980 [CH] Switzerland ..... 5589/80

[51] Int. Cl.[3] ..... E03C 7/00

[52] U.S. Cl. ..... 430/15; 430/17; 430/390; 430/391; 430/505; 430/509; 430/559; 430/565

[58] Field of Search ..... 430/14, 15, 17, 390, 430/391, 509, 505, 559, 565

[56] References Cited

U.S. PATENT DOCUMENTS

| | | | |
|---|---|---|---|
| 3,708,300 | 1/1973 | Luckey | 430/505 |
| 4,082,553 | 4/1978 | Eroet | 430/504 |
| 4,197,123 | 4/1980 | Oetiker et al. | 430/391 |
| 4,310,617 | 1/1982 | Mollet et al. | 430/390 |

*Primary Examiner*—Mary F. Downey
*Attorney, Agent, or Firm*—Joseph G. Kolodny

[57] ABSTRACT

Negative color images are produced by the silver dye bleach process, by exposure of a photographic silver dye bleach material, silver developing, dye bleaching, silver bleaching and fixing, the silver bleaching being optionally carried out simultaneously with the dye bleaching and/or the fixing, in a single treatment bath. The photographic material consists of a support with at least one layer assembly of three layers in each case, each layer assembly containing, as viewed from the same side as the incident light:

(a) a first layer which contains a highly sensitive and optionally spectrally sensitized silver halogenoiodide emulsion, (b) an intermediate layer containing neither silver halide nor image dye, and (c) a third layer which contains a bleachable image dye and a core-shell emulsion which is free of iodide or has a low iodide content, the particles of which emulsion consist of a surface-fogged silver halide core optionally treated with a developing retarder, and of a silver halide shell enclosing the said core, and the material, in the case where it contains more than one layer assembly, contains optionally intermediate layers (d) between the layer assemblies.

The material according to the invention is distinguished by enhanced sensitivity and increased contrast in the positive silver image.

The developing is carried out in a developer solution which does not contain any silver-complexing agents.

16 Claims, 1 Drawing Figure

Figure 1:
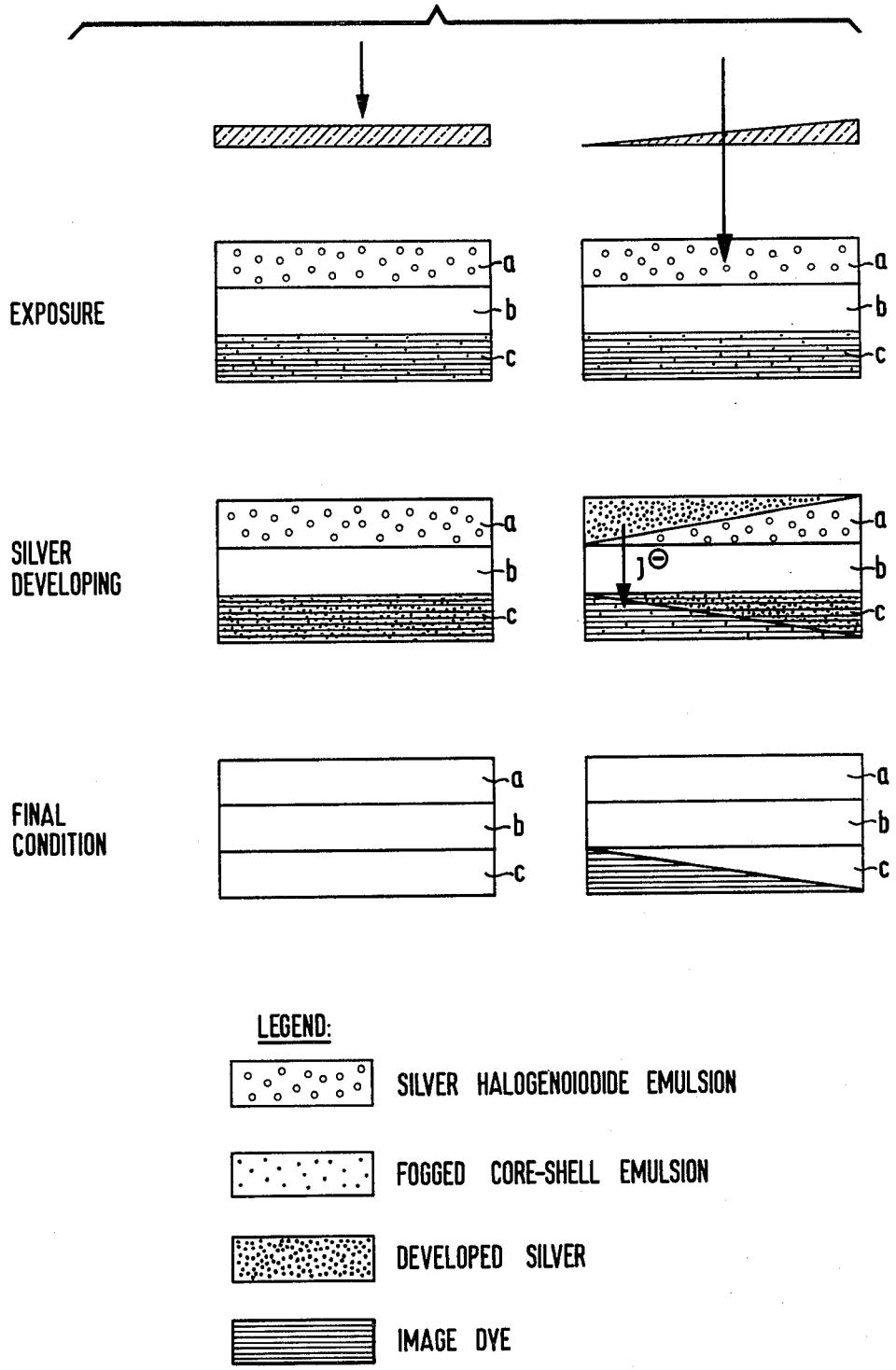

PROCESS FOR THE PRODUCTION OF NEGATIVE COLOR IMAGES BY THE SILVER DYE BLEACH PROCESS, AND THE SILVER DYE BLEACH MATERIAL USED IN THIS PROCESS

The present invention relates to a novel process for the production of negative photographic colour images by the silver dye bleach process and to the silver dye bleach material used in this process.

As is known, the silver dye bleach process is based on the fact that certain categories of dyes, in particular azo dyes, are reductively bleached, in the presence of finely divided silver, by strongly acid baths containing a silver-complexing agent. This reaction can be accelerated by catalysts, in particular diazine compounds.

The action of finely divided silver on dyes can be used for the purpose of converting photographically produced silver images to colour images. In the normal case, the silver image initially formed in this process is negative, i.e. is the counter-image of the original. In the subsequent dye bleach process, a second image reversal takes place so that the dye image finally formed is positive, i.e. is identical to the original. The silver dye bleach process is therefore used primarily to produce positive colour copies starting from diapositives.

So that the silver dye bleach process can also be employed for the production of negative colour images, it is necessary to start from a positive silver image. Several processes are known for the production of positive silver images;

(a) Reversal developing: the negative silver image initially formed after exposure and a first developing is oxidatively bleached, whilst the silver halide which has been subjected to diffuse exposure or has been chemically fogged is processed by a second developing to give a positive image (for example German Auslegeschrift No. 1,145,487).

(b) Direct positive emulsions: these work either by the interior image principle or by the surface fogging principle, with the concomitant action of desensitisers, and produce a positive silver image directly.

(c) Silver complex diffusion: developers which contain silver-complexing agents are used for the developing of the negative silver image. The undeveloped unexposed silver halide regions dissolve in the developer as silver complexes and migrate imagewise into a receiver layer which contains developing nuclei. At these nuclei, silver is deposited from the silver complex-containing developer solution by physical developing, whereby a positive image is formed (for example German Offenlegungsscrift No. 1,572,206 or British Patent Specification No. 656,131).

(d) Bromide ion or iodide ion diffusion: in the developing of exposed silver bromide emulsions or silver chloride emulsions, the formation of metallic silver is accompanied by the release of the corresponding halide ion, which can then diffuse freely in the emulsion layer. Such ions possess the property of disturbing or preventing the developing of exposed crystals of more soluble silver halides. Thus, bromide ions inhibit the developing of silver chloride emulsions and iodide ions inhibit the developing of silver chloride emulsions or silver bromide emulsions. This applies both to the conventional chemical developing and also to the physical developing of silver halide emulsions.

The production of positive silver images by bromide ion diffusion is illustrated in German Patent Specification No. 859,711. An emulsion layer of the photographic material contains highly sensitive silver bromide, relatively insensitive, fogged silver chloride, and colloidal silver, which supplies the developing nuclei. In the developing of the primary image formed in the silver bromide, bromide ions are formed which stop the spontaneous developing of adjacent silver chloride particles. Because the positive image thus formed from the silver chloride possesses a much greater covering power than the negative image simultaneously formed from the silver bromide, the net result is a positive image.

A process described in U.S. Pat. No. 3,695,881 is based on iodide ion diffusion. In this process, an unfogged interior image emulsion, which is made difficult to fix by treatment with a heterocyclic nitrogen compound, is arranged in the layer adjacent to an emulsion containing silver iodide. In the fixing step, the iodide ions migrating out of the silver iodide emulsion favour the dissolution of the interior image emulsions treated in this way. This again gives a positive image in this emulsion, and the positive image can be employed for the production of a colour image.

One disadvantage of the known silver dye bleach materials consists of the fact that it is normally inevitable that light-absorbing dyes are incorporated into emulsion layers which are sensitised precisely in the main absorption region of the dye. This results in a great loss of sensitivity.

A further disadvantage is apparent on considering a particular silver dye bleach process, utilising iodide ion diffusion. For example, if a photographic material which contains, on a base, a bleachable dye and a relatively insensitive, surface-fogged silver halide emulsion in an undermost layer, and a dye-free, highly sensitive, silver iodide-containing silver bromide emulsion in a superimposed layer, these two layers being separated by a third layer which only contains binder, is exposed and developed and then subjected to the conventional dye bleach process, the following processes take place:

The spontaneous developing of the surface-fogged silver halide emulsion starts before the iodide ions can diffuse in from the uppermost layer. Thus, no positive silver image, or only a very poorly contrasted positive image, is formed.

The object of the present invention is thus to provide a process for the production of negative photographic colour images, utilising iodide ion diffusion, which process extensively overcomes these disadvantages.

It has now been found that an increase in the contrast of the positive silver image can be obtained if a core-shell emulsion is used in the layer containing a bleachable dye, the particles of which emulsion contain a fogged core optionally treated, with a developing retarder. The start of the spontaneous developing of the core-shell emulsion can be influenced by choosing a suitable shell thickness around the fogged core, so that the spontaneous developing takes place at the same time as the diffusion of the iodide ions which control the developing.

An additional action which retards developing can be obtained by treating the cores also with one of the usual developing retarders, before application of the silver halide shell.

Furthermore, an improvement in sensitivity is achieved because the dye does not have to be present in the light-sensitive layer. It is thus also possible to use strongly light-absorbing dyes, for example black dyes, the application of which in a silver dye bleach material is normally precluded. This makes it possible to produce a black/white negative material, the silver content of which can be completely recovered.

One object of the invention is thus a process for the production of negative colour images by the silver dye bleach process, by exposure of a photographic material, silver developing, dye bleaching, silver bleaching and fixing, the silver bleaching being optionally carried out simultaneously with the dye bleaching and/or fixing, in a single treatment bath, in which process the photographic material consists of a support with at least one layer assembly of three layers in each case, each layer assembly containing, as viewed from the same side as the incident light:

(a) a first layer which contains a highly sensitive and optionally spectrally sensitised silver halogenoiodide emulsion, (b) an intermediate layer containing neither silver halide nor image dye, and (c) a third layer which contains a bleachable image dye and a core-shell emulsion which is free or iodide or has a low iodide content, the particles of which emulsion consist of a surface-fogged silver halide core optionally treated with a developing retarder, and of a silver halide shell enclosing the said core, it being possible for this emulsion to be developed spontaneously up to the maximum density by the action of a developer, the photographic material, in the case where it consists of more than one layer assembly, optionally contains intermediate layers (d) between the layer assemblies and the developing is carried out in a developer solution which is free of silver-complexing agent.

In layer (a) silver halogenoiodide comprises silver chloro- and bromoiodide.

A further object of the invention relates to the silver dye bleach material suitable for the process according to the invention. Further objects of the present invention are the use of the silver dye bleach material, suitable for the process according to the invention, for the production of negative colour images, and the colour images produced in accordance with the process.

If the photographic material according to the invention, described above, is exposed and developed and then subjected to the customary dye bleach process, the following processes, represented in the FIGURE take place:

The highly sensitive iodide-containing silver bromide emulsion layer (a), located in the uppermost position tion, is exposed imagewise. Because this layer does not contain any dye, a very high photographic sensitivity is achieved. The fogged core-shell emulsion in the undermost layer (c) is at most weakly exposed, because of its low sensitivity, but, because of its spontaneous developability, this is of no consequence.

In the subsequent developing, iodide ions are formed imagewise in the uppermost layer (a) and these diffuse through the intermediate layer (b) to the undermost layer (c) and, in the latter, inhibit the spontaneous developing of the fogged core-shell emulsion imagewise. A positive silver image is thus formed in this layer. After bleaching of the dye and removal of all remaining silver compounds, the desired negative colour image is finally obtained in the undermost layer.

If three of the layer assemblies described above, which each contain a cyan dye, a magenta dye and a yellow dye in the layers (c), are combined to form a trichromatic silver dye bleach material, intermediate layers (d) are optionally, between the individual layer assemblies.

The highly sensitive silver halogenoiodide emulsion in the layer (a) can show its maximum sensitivity either inside or outside the spectral region of the complementary colour of the image dye in the layer (c).

The trichromatic material described is distinguished by especially high sensitivity.

Silver halide crystals with a diffusion-inhibiting silver halide shell can be produced in a simple manner by the known core-shell technique. Monodisperse emulsions, the crystals of which are all within a relatively restricted size range, are preferably used for this purpose. An emulsion of this type is fogged on the core surface by customary methods, for example by exposure or by means of chemical agents known per se, as described inter alia in German Offenlegungsschriften Nos. 1,597,488 and 2,801,127, U.S. Pat. No. 3,761,266 and Research Disclosure 16, 345 (1977).

The fogged crystals can optionally be treated with a developing inhibitor which attaches itself firmly to their surface by adsorption, before they are provided, by further precipitation of silver halide, with a thin shell covering the developing centres.

All the usual silver halides, i.e. silver chloride, silver bromide and silver iodide, or mixed crystals of two or all three components, can be used as silver halide crystals to be enclosed. To ensure uniform growth of the shell, it is advantageous if the crystals to be enclosed are as similar as possible in size. Monodisperse emulsions, such as those which can be produced by known methods, for example in cubic or octahedral crystal habit, are therefore used in particular. The production of monodisperse emulsions is described, for example, in German Offenlegungsschrift No. 1,904,148.

The shell to be applied can consist of a different silver halide (different silver halides) from the core or of the same silver halide(s). The radius ratio of core to shell can also vary within wide limits, the particles suitable for the present invention being primarily those for which the shell thickness is small compared with the core diameter.

Three methods in particular are usual for applying the shell to the core:

(a) the precipitation of further silver halide on top, by the simultaneous addition of soluble silver salt and soluble halide, the precipitation conditions (concentration and rate of addition) being chosen so that no new crystallisation nuclei are formed (for example German Offenlegungsschrift No. 2,015,070).

(b) The addition of a finely disperse silver halide emulsion, the crystals of which are substantially smaller than the crystals to be enclosed. The finely disperse crystals disappear, a shell of the material of the added finely disperse emulsion forming around the coarser crystals, as in Ostwald ripening (for example U.S. Pat. No. 3,206,313).

(c) Precipitation during periodic changing of the pAg value between silver excess and halide excess. Particles with a multilayer structure can be produced in this way (for example U.S. Pat. No. 3,917,485).

It has been found that choosing a suitable shell thickness around the fogged core of a core-shell particle is an excellent method of delaying the start of the spontaneous developing so that the latter takes place at the same time as the diffusion of the iodide ions controlling the developing. Shell thicknesses of between 50 and 1,000 A, corresponding to about 7 to 140 silver halide lattice planes, and preferably 100 to 250 A, represent a suitable range for the process according to the invention.

Another possible method of influencing the start of developing of the core-fogged core-shell emulsions consists in choosing various concentrations of an ammonium sulfite or alkali metal sulfite in the developer solution. The kinetics of spontaneous developing can be controlled within wide limits by the sulfite concentration (2 to 100 g per liter of developer solution).

The start and the rate of the developing process can in addition be influenced by the use of substances which retard developing. Such substances can preferably be adsorbed on the fogged surface of the core before growing the shell.

The core-shell technique makes it possible to carry out the customary photographic operations which affect the surface, for example ripening, fogging, sensitising or the accumulation of further substances such as stabilisers, developing accelerators and developing retarders, on the silver halide crystals to be enclosed, and thereafter to place the surface treated in this way inside the crystal by growing the shell on top [for example German Offenlegungsschrift No. 2,260,117 and E. Moisar and S. Wagner, Ber. Bunsengesellshaft 67, 356 (1963)].

Examples of suitable developing inhibitors and developing retarders are benzotriazole, 2-mercaptobenzothiazole, N-methylmercaptotriazole, phenylmercaptotetrazole, triazolindolizine and their derivatives.

An important condition here is that the solubility product of the silver salt formed from the developing retarder is between that of silver chloride and that of silver iodide [c.f. A. B. Cohen et al., Photographic Sci. and Eng. 9, 96, (1965)].

Basically, all known developing retarders which satisfy this condition are suitable. However, those compounds which can be incorporated in a diffusion-resistant form in the photographic layers are preferably suitable. These are primarily compounds containing ballast groups, which are sparingly soluble or insoluble in water. Examples of suitable compounds of this type are 5-mercaptotetrazoles which are substituted in the 1-position by aryl groups, preferably polynuclear aryl such as naphthyl or diphenyl, and are also unsubstituted or substituted by aryl groups substituted by preferably higher alkyl ($C_{13}$–$C_{18}$), especially phenyl, and are also substituted by aralkyl or by alkyl preferably having at least 3, especially 3 to 18, carbon atoms.

Examples of particularly suitable developing retarders are 5-mercaptotetrazoles which are substituted in the 1-position by one of the following groups: n-propyl, i-propyl, n-butyl, i-butyl, t-butyl, i-amyl, i-octyl, t-octyl, nonyl, decyl, lauryl, myristyl, palmityl, stearyl, ditert.-butyl-phenyl, octylphenyl, dodecylphenyl, naphthyl, $\alpha$- or $\beta$-naphthyl or diphenyl. It is also possible to use mercaptotetrazoles not containing true ballast groups, which are not diffusion-resistant. However, in this case, care must be taken that the developing retarder does not diffuse in an undesirable direction into an adjacent layer and, for example, retard the developing of the emulsions which supply iodide ions. This can be achieved, for example, by inserting an intermediate layer. Under this condition, it is also possible, for example, to use 5-mercaptotetrazoles which are substituted in the 1-position by the following groups: phenyl, phenyl substituted by hydroxyl, halogen (chlorine or bromine) or lower alkyl ($C_2$–$C_3$), methyl or ethyl benzoate, methyl or ethyl. In general, however, the use of diffusion-resistant developing retarders is to be preferred because the layer assembly, especially the assembly of materials having a multiplicity of colour layers and emulsion layers, can thereby be substantially simplified. The developing retarders are used in amounts of 1 to 80 millimols, preferably of 3 to 40 millimols, per mol of silver in the pre-fogged emulsion.

The fogging of the silver halide crystals which then form the core of a core-shell particle is carried out by customary methods, for example by diffuse exposure or using the conventional chemical agents, for example thiourea dioxide, tin(II) chloride, hydrazine, boranes, formaldehyde-sulfoxylates or gold salts (complexes). Because the fogged cores are not intended to develop too rapidly, they are preferably produced using silver bromide emulsions or silver chlorobromide emulsions. Lower proportions of up to about 20 mol percent silver chloride can be used; emulsions with higher silver chloride contents can in general develop too rapidly. The proportion of silver iodide should only be low and should not exceed about 1.0 mol percent, because the influence, which is important for the process according to the invention, on the developing by migrating iodide ions would not otherwise be ensured.

The silver halide shell to be applied can consist of a different silver halide (different silver halides) from the core, of the same silver halides as the core, but in different halide proportions, or, preferably, of the same silver halide or halides as the core, in the same halide proportions.

If the surface of the emulsion core is also treated with a developing retarder, this treatment is advantageously carried out after fogging, but still before growing the shell.

Basically, all dyes which are generally used for the silver dye bleach process are suitable as bleachable dyes for the process according to the invention. If trichromatic negative images are to be produced, one of the subtractive primary dyes cyan, magenta and yellow is used in each layer assembly. To prevent bleach couplings, an additional separating layer (d) must in this case be arranged between every two layer assemblies. However, the process is also suitable for the production of monochromatic negative images, an important application relating to the production of negative black/white images as can be obtained by using a bleachable black dye.

A further use of monochromatic negative images consists of the production of positive black/white images. In this case, the dye of the negative images according to the invention takes over the role of the light-absorbing silver halide of normal photographic materials.

Bleachable dyes which are suitable for the process according to the invention are described, for example, in U.S. Pat. Nos. 3,454,402, 3,443,953, 3,804,630, 3,716,368, 3,877,949, 3,623,874, 3,931,142 and 4,051,123.

The intermediate layers (d) (barrier layers and separating layers) generally contain only pure binder, for example gelatin, but no dye and no silver halide. If it is advantageous for the total layer sequence, however, it can be possible for an emulsion layer already present or a filter layer to be used as a separating layer. Apart from gelatin, the separating layer can also contain further additives, such as substances which inhibit dye bleaching, additional binders, for example water-soluble colloids or also water-insoluble dispersion polymers, and also the customary additives for the assembly of the other photographic layers, such as plasticisers, wetting agents, light stabilisers, filter dyes, fluorescent brighteners, UV-absorbers or hardeners.

The highly sensitive silver halogenoiodide emulsions (first layer of a layer assembly as viewed from the same side as the incident light) which are normally used are those which contain silver chloride and/or bromide and silver iodide. The iodide content is normally between 0.1 and 10, preferably 1 and 5, mol percent, the remainder consisting of silver chloride and/or bromide (for example 0 to 99.9 mol percent of silver chloride and 0 to 99.9 mol percent of silver bromide).

To produce these emulsions, gelatin is customarily used as a protective colloid; however, other water-soluble protective colloids, such as polyvinyl alcohol or polyvinylpyrrolidone or the like, can also be used; furthermore, part of the gelatin can be replaced by dispersions of water-insoluble high-molecular substances. It is common, for example, to use dispersion polymers consisting of $\alpha,\beta$-unsaturated compounds, such as acrylic acid esters, vinyl esters and ethers, vinyl chloride and vinylidene chloride, and also consisting of other mixtures and copolymers.

The emulsions can be applied to customary layer supports for photographic recording material. Optionally, a mixture of several colloids can be used for dispersing the silver halides.

The support can consist, for example, of cellulose triacetate or polyester, which can be pigmented. If it consists of paper felt, this must be varnished on both sides or coated with polyethylene.

The processing of the exposed silver dye bleach materials is carried out in the conventional manner and comprises silver developing, dye bleaching, silver bleaching and fixing and then washing, it also being possible for washing to take place between the individual steps (c.f., for example, German Offenlegungsschrift No. 2,448,443). The dye bleaching and the silver bleaching, and optionally the fixing, can be combined in a single treatment step. It is also possible to incorporate developer compounds or developer precursors into the emulsion layers. Care is taken here to ensure, by suitable buffering, that these substances remain inactive in the dry layer during storage. In this case, only an activating bath with a high pH value, which can be free of developer substances, is necessary for starting the developing.

For silver developing, it is possible to use baths of conventional composition, for example baths which contain hydroquinone as the developer substance, or additionally 1-phenyl-3-pyrazolidinone, but no silver-complexing agents. Moreover, it can be advantageous if the silver developing bath, as described in Swiss Patent Specification No. 405,929, additionally contains a dye bleach catalyst. As active substances, activating baths contain only strong alkalis and, optionally, further additives such as buffer substances, wetting agents and the like.

If the dye bleaching is carried out as a separate treatment step, the dye bleach baths used advantageously contain a dye bleach catalyst in addition to a strong acid, a water-soluble iodide and an antioxidant for the iodide. Combined dye bleach and silver bleach baths as a rule also contain a water-soluble oxidising agent in addition to the components indicated. Suitable dye bleach catalysts are primarily diazine compounds, for example those described in German Auslegeschriften Nos. 2,010,280, 2,144,298 and 2,144,297, in French Patent Specification No. 1,489,460, in U.S. Pat. No. 2,270,118 and in German Offenlegungsschrift No. 2,448,443.

Strong acids are to be understood here as meaning acids which impart a pH value of at most 2 to the dye bleach bath or combined dye bleach and silver bleach bath. Thus, for example, it is possible to use hydrochloric acid, phosphoric acid and especially sulfuric acid or sulfamic acid.

Alkali metal iodides, for example potassium iodide or sodium iodide, can be used as the water-soluble iodide.

Suitable oxidising agents are nitroso compounds, for example p-nitrosodimethylaniline, and nitro compounds, for example aromatic nitro compounds and preferably aromatic mono- or di-nitrobenzenesulfonic acids, for example m-nitrobenzenesulfonic acid.

The antioxidants used are especially reductones or water-soluble mercapto compounds. Suitable reductones are, in particular, aci-reductones which have a 3-carbonylene-1,2-diol grouping, such as reducti nic acid, triosereductone or, preferably, ascorbic acid.

Possible mercapto compounds are those of the formula HSA(B)m, in which A is an aliphatic, cycloaliphatic, araliphatic, aromatic or heterocyclic bridge member, B is a water-solubilising radical and m is an integer of at most 4 (German Offenlegungsschriften Nos. 2,258,076 and 2,423,819).

The silver fixing bath can be made up in a known and conventional manner. A suitable fixing agent is, for example, sodium thiosulfate or, preferably, ammonium thiosulfate, optionally together with additives such as sodium bisulfite, sodium metabisulfite and/or ammonium bisulfite, and, optionally, a complexing agent such as ethylenediaminetetraacetic acid.

All treatment baths can contain further conventional additives, for example hardeners, wetting agents, fluorescent brighteners or UV stabilisers.

In the following example, parts and percentages are by weight, unless stated otherwise.

EXAMPLE

The following layers are applied to a transparent polyester support in the order indicated:

1. A layer which contains a chemically fogged core-shell emulsion treated with a developing retarder (inhibitor), with a silver content of 0.8 g/m$^2$, and 0.3 g/m$^2$ of a black bleachable dye of the formula

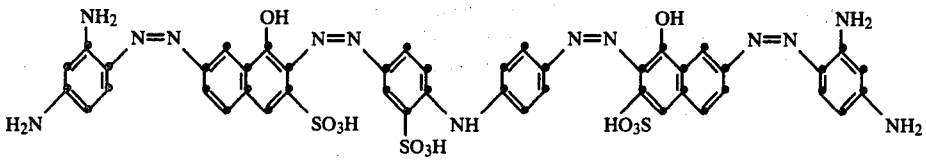

The core-shell emulsion used in this layer is produced as follows:

A cubic-monodisperse silver bromide emulsion (edge length: 0.55μ) is chemically fogged, for one hour at 60° C., with a solution of 0.01% of sodium formaldehydesulfoxylate ($HOCH_2SO_2Na.2H_2O$) and 0.001% of chloroauric acid ($HAuCl_4$). The fogged emulsion is inhibited by adding 3 mg of 1-phenyl-5-mercaptotetrazole per g of silver, in the form of a 1% solution. A 0.02μ thick silver bromide shell is precipitated onto the silver bromide crystals pretreated in this way.

2. A gelatin intermediate layer with an application weight of 5 g/m² of gelatin.
3. A green-sensitised silver iodobromide gelatin emulsion layer (95 mol % of AgBr and 5 mol % of AgI) with an application weight of 0.8 g of silver/m².

A sample of the material coated in this way is exposed with green light under a graded wedge and processed as follows:

| (a) Developing | 3 minutes at 30° C. |
|---|---|
| Potassium sulfite | 2.0 g |
| Sodium sulfite | 40.0 g |
| Boric acid | 2.2 g |
| Hydroquinone | 14.9 g |
| Na formaldehyde-bisulfite | 44.0 g |
| Diethylenetriaminepentaacetic acid | 4.6 g |
| Potassium carbonate | 49.6 g |
| Potassium hydroxide | 0.74 g |
| Potassium bromide | 2.0 g |
| Diethanolamine | 12.9 g |
| Iso-ascorbic acid | 1.5 g |
| Triethylene glycol | 33.5 g |
| Water to | 1 liter |
| **(b) Combined dye bleaching and silver bleaching** | **3 minutes at 30° C.** |
| Sulfuric acid (96%) | 40.0 g |
| Na 3-nitrobenzenesulfonate | 6.0 g |
| Potassium iodide | 8.0 g |
| 2,3,6-Trimethylquinoxaline | 2.0 g |
| Acetic acid (100%) | 2.1 g |
| 3-Mercaptobutyric acid | 1.75 g |
| Ethylene glycol monoethyl ether | 46.7 g |
| Water to | 1 liter |
| **(c) Fixing** | **3 minutes at 20° C.** |
| Ammonium thiosulfate (98%) | 200 g |
| Potassium metabisulfite | 25 g |
| Potassium hydroxide (85%) | 11 g |
| Water to | 1 liter |

After the processing a negative black/white image, i.e. a black/white image which is the counter-image of the original, of very high contrast ($\gamma \approx 5$), is obtained.

The measured transmission densities are reproduced in the following Table 1:

TABLE 1

| Density of original | Transmission density |
|---|---|
| 0 | 0.88 |
| 0.3 | 0.89 |
| 0.6 | 0.88 |

TABLE 1-continued

| Density of original | Transmission density |
|---|---|
| 0.9 | 0.88 |
| 1.2 | 0.89 |
| 1.5 | 0.89 |
| 1.65 | 0.84 |
| 1.8 | 0.65 |
| 1.95 | 0.10 |
| 2.1 | 0.08 |
| 2.4 | 0.07 |

What is claimed is:

1. A process for the production of negative colour images by the silver dye bleach process, by exposure of a photographic silver dye bleach material, silver developing, dye bleaching, silver bleaching and fixing, the silver bleaching being optionally carried out simultaneously with the dye bleaching and/or the fixing, in a single treatment bath, in which process the photographic silver dye bleach material consists of a support with at least one layer assembly of three layers in each case, each layer assembly containing, as viewed from the same side as the incident light:

(a) a first layer which contains a highly sensitive and optionally spectrally sensitised silver halogenoiodide emulsion, (b) an intermediate layer containing neither silver halide nor image dye, and (c) a third layer which contains a bleachable image dye and a core-shell emulsion which is free of iodide or has a low iodide content, the particles of which emulsion consist of a surface-fogged silver halide core optionally treated with a developing retarder, and of a silver halide shell enclosing the said core, it being possible for this emulsion to be developed spontaneously up to the maximum density by the action of a developer, the photographic material, in the case where it consists of more than one layer assembly, optionally contains intermediate layers (d) between the layer assemblies and the developing is carried out in a developer solution which is free of silver-complexing agent.

2. A process according to claim 1, wherein the core and shell of a core-shell particle consist of silver bromide or silver chlorobromide with a content of at most 20 mol % of silver chloride and at most 1.0 mol % of silver iodide.

3. A process according to claim 2, wherein the core and shell of a core-shell particle consist of the same silver halide(s).

4. A process according to claim 1, wherein the core of a core-shell particle is fogged by prior exposure or by chemical treatment, before the shell is applied.

5. A process according to claim 1, wherein the core is optionally treated with a developing retarder after fogging but before the shell is applied.

6. A process according to claim 5, wherein the developing retarder used is a 5-mercaptotetrazole substituted in the 1-position by an alkyl, aryl or aralkyl group.

7. A process according to claim 6, wherein the developing retarder used is a 5-mercaptotetrazole substituted in the 1-position by alkyl having at least 3 carbon atoms, aryl having at least two nuclei or aralkyl having at least three carbon atoms in the alkyl moiety.

8. A process according to claim 1, wherein the fogged core of a core-shell particle is enclosed by an unfogged silver halide shell with a thickness of between 50 and 1,000 A, preferably 100 to 250 A.

9. A process according to claim 1, wherein a trichromatic material is used which consists of three layer assemblies each consisting of three layers and each having a cyan image dye, a magenta image dye and a yellow image dye in the layers (c), with intermediate layers (d) optionally arranged between the layer assemblies.

10. A process according to claim 9, wherein the highly sensitive silver halogenoiodide emulsion in the layer (a), associated with the image dye within a layer assembly, shows the maximum spectral sensitivity inside or outside the spectral region of the complementary colour of the image dye in the layer (c).

11. A process according to claim 1, wherein the silver halogenoidide emulsions contain 0 to 99.9 mol % of silver chloride, 0 to 99.9 moL % of silver bromide and 0.1 to 10, preferably 1 to 5, mol % of silver iodide.

12. A process according to claim 1, wherein at least one of the intermediate layers (b) within the layer assemblies, and/or of the intermediate layers (d) between the layer assemblies, contains, apart from the binder, further substances such as bleach inhibitors, filter dyes, light stabilisers, fluorescent brighteners, plasticisers, UV-absorbers or wetting agents.

13. A process according to claim 1, wherein a developer substance or a developer precursor is incorporated in at least one of the layers of the photographic material, and, in this case, a strongly alkaline activating bath is used for the developing instead of a developing bath.

14. A process according to claim 1, wherein a developer solution is used which contains 2 to 100 g/liter of an alkali metal sulfide or ammonium sulfide, for the purpose of controlling the kinetics of spontaneous developing.

15. A photographic silver dye bleach material for the production of negative colour images, which consists of a support with at least one layer assembly of three layers in each case, each layer assembly containing, as viewed from the same side as the incident light:

(a) a first layer which contains a highly sensitive and optionally spectrally sensitised silver halogenoiodide emulsion, (b) an intermediate layer containing neither silver halide nor image dye, and (c) a third layer which contains a bleachable image dye and a core-shell emulsion which is free of iodide or has a low iodide content, the particles of which emulsion consist of a surface-fogged silver halide core optionally treated with a developing retarder, and of a silver halide shell enclosing the said core, and the material, in the case where it contains more than one layer assembly, contains optionally intermediate layers (d) between the layer assemblies.

16. A colour image produced by the process according to claim 1.

* * * * *